US006621478B1

(12) United States Patent
Sakaguchi et al.

(10) Patent No.: US 6,621,478 B1
(45) Date of Patent: Sep. 16, 2003

(54) SEMICONDUCTOR DEVICE AND DISPLAY MODULE

(75) Inventors: Nobuhisa Sakaguchi, Tenri (JP); Yoshinori Ogawa, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 73 days.

(21) Appl. No.: 09/722,586

(22) Filed: Nov. 28, 2000

(30) Foreign Application Priority Data

Feb. 29, 2000 (JP) ..... 2000-054678

(51) Int. Cl.[7] ..... G09G 3/36; G09G 5/00

(52) U.S. Cl. ..... 345/98; 345/89; 345/95; 345/211; 345/213

(58) Field of Search ..... 345/89, 95, 97, 345/22, 210, 213, 98; 365/201, 78; 250/208.1

(56) References Cited

U.S. PATENT DOCUMENTS 4,309,649 A * 1/1982 Naito ..... 323/212
4,495,473 A * 1/1985 Treise ..... 331/10
4,760,387 A * 7/1988 Ishii et al. ..... 345/22
5,179,371 A * 1/1993 Yamazaki ..... 345/210
5,828,357 A 10/1998 Tamai et al. ..... 345/89
5,909,206 A * 6/1999 Yokota et al. ..... 345/213
6,002,384 A 12/1999 Tamai et al. ..... 345/95
6,320,177 B1 * 11/2001 Sayag ..... 250/208.1
6,421,789 B1 * 7/2002 Ooishi ..... 365/201

FOREIGN PATENT DOCUMENTS

JP 363138591 A * 6/1988 ..... 365/78

OTHER PUBLICATIONS

The Delphion Integrated View Ishii et al. Oct. 1989.*

* cited by examiner

*Primary Examiner*—Amare Mengistu
*Assistant Examiner*—Prabodh Dharia
(74) *Attorney, Agent, or Firm*—Birch, Stewart, Kolasch & Birch, LLP

(57) ABSTRACT

A liquid crystal drive device includes: a shift register circuit for transfer a start pulse signal SP in synchronism with a clock signal CK; an input latch circuit for picking up display data DR, DG, and DB in synchronism with the clock signal CK; and a sampling memory circuit for sampling and storing the display data DR, DG, and DB according to the transferred start pulse signal SP, wherein the input latch circuit is adapted to pick up the display data DR, DG, and DB at both a leading edge and a trailing edge of the clock signal CK. The liquid crystal drive device provides a versatile solution to improvement of the resolution of the liquid crystal display.

13 Claims, 14 Drawing Sheets

CK1

CK2

D
D1
D2
D3
D4
D5
D6
D7
D8
FIG. 8 (d) (Q11)
LEADING EDGE SYNCHRONOUS DATA
FIG. 8 (e) (Q13)
LEADING EDGE SYNCHRONOUS DATA
FIG. 8 (f) (Q12)
TRAILING EDGE SYNCHRONOUS DATA
FIG. 8 (g) (Q14)
TRAILING EDGE SYNCHRONOUS DATA
FIG. 8 (h) (Q21)
FIG. 8 (i) (Q23)
FIG. 8 (j) (Q22)
FIG. 8 (k) (Q24)

SEMICONDUCTOR DEVICE AND DISPLAY MODULE

FIELD OF THE INVENTION

The present invention relates to semiconductor devices for driving a display device with a display data signal which has been subjected to digital/analogue conversion to effect a tone display, and further relates to display modules incorporating such a semiconductor device.

BACKGROUND OF THE INVENTION

Popularly known, conventional liquid crystal display devices include those using TFTs (thin film transistors) shown in FIG. 11, which is a typical active matrix addressing method. The liquid crystal display device is constituted by: a TFT liquid crystal panel 901 as a liquid crystal display section; and a liquid crystal drive device. Inside the liquid crystal panel 901, there are provided liquid crystal display elements (not shown) and opposite electrodes (common electrodes) 906.

The liquid crystal drive device includes source drivers 902, gate drivers 903, a controller 904, and a liquid-crystal-drive power source 905. The source and gate drivers 902 and 903 each include an integrated circuit. The controller 904 provides display data D and a control signal S11 to the source drivers 902 and a control signal S12 to the gate drivers 903. The control signal S11 may be a horizontally synchronized signal or a clock signal, for example. The control signal S12 may be a vertically synchronized signal, for example.

The output terminal for a liquid-crystal-drive voltage of each source driver 902 is coupled to an associated source signal line of the liquid crystal panel 901. The output terminal for a liquid-crystal-drive voltage of each gate driver 903 is coupled to an associated gate signal line of the liquid crystal panel 901. The liquid-crystal-drive power source 905 supplies power to drive the liquid crystal drive devices (source and gate drivers 902 and 903) and also provides various drive voltages which will be applied to the liquid crystal panel 901.

The digital display data D is externally provided in a serial data format to the controller 904 and then transmitted to the source drivers 902. Each source driver 902 latches the incoming display data D as a time series and converts it from serial to parallel, before performing digital-to-analogue conversion (hereinafter, D/A conversion) on the display data D in synchronism with the horizontally synchronized signal supplied from the controller 904. The analogue display data D is then fed as a display signal from the source driver 902. The display signal contains an analogue voltage (tone display voltage) to effect a tone display.

Supplied from the source driver 902 through its output terminal for a liquid-crystal-drive voltage, the D/A converted display signal is transmitted via the source signal line to an associated liquid crystal display element (not shown) in the liquid crystal panel 901.

FIG. 12 shows, as an example, a block diagram of a circuit structure of the source driver 902. The source driver 902 is primarily constituted by a shift register circuit 1302, an input latch circuit 1301, a sampling memory circuit 1303, a hold memory circuit 1304, a level shifter circuit 1305, a D/A conversion circuit 1306, an output circuit 1307, and a reference voltage generating circuit 1309.

The shift register circuit 1302 includes shift registers with n stages. A start pulse signal SP in synchronism with the horizontally synchronized signal is supplied to the first stage in the shift register circuit 1302 and subsequently passed on from one stage to a next in synchronism with a clock signal CK until it reaches the n-th stage in the shift register circuit 1302.

The output of the n-th stage in the shift register circuit 1302, designated as an output signal SPO, is supplied as a start pulse signal SP to a next source driver 902 (the source drivers 902 are connected in cascade). The start pulse signal SP is passed on from a source driver 902 to another.

The display data D is composed of, for example, three kinds of 6-bit display data DR (red), DG (green), and DB (blue), and is provided to the input latch circuit 1301, where it is latched temporarily before being fed to the sampling memory circuit 1303 according to the clock signal CK. The sampling memory circuit 1303 performs sampling and stores the incoming time-series (serial) display data D according to the output signal from various stages in the shift register circuit 1302 (the signal derived by shifting the start pulse signal SP).

The display data D is then supplied to the hold memory circuit 1304, where the display data D is latched according to a latch signal LS derived from the horizontally synchronized signal when part of the display data D for a single horizontal period is fed to the hold memory circuit 1304. The hold memory circuit 1304 then holds the display data D until it receives a next latch signal LS, that is, for one horizontal period, before sending out the display data D.

The levels of signals representative of the latched display data D are changed by the level shifter circuit 1305 from voltage levels as logic representations (Vcc-GND levels) to those required to drive the liquid crystal (VDD-GND levels).

Meanwhile, the reference voltage generating circuit 1309 produces, for example, 64 different levels of voltages, based on reference voltages VR (including, for example, Vref1 to Vref9), which will be used to effect a tone display using a potential dividing or another technique. The D/A conversion circuit 1306 converts to analogue voltages by selecting one of the 64 voltage levels according to the incoming display data D composed of the aforementioned three kinds of 6-bit display data DR, DG, and DB, which have been latched and changed in levels. The D/A conversion circuit 1306 then outputs the results as display signals.

These display signals having various voltage levels are fed as tone display voltages from the output circuit 1307 which includes a voltage follower circuit via the output terminals 1308 for liquid-crystal-drive voltages to source signal lines of a liquid crystal display element in the liquid crystal panel 901.

As illustrated in FIG. 12 (only a single circuit is shown) and in FIG. 13, external serial inputs (D1, D2, . . . D8, . . . ) of digital display data (DR, DG, and DB) received by the conventional-source driver described above is latched temporarily by the input latch circuit 1301 constituted by a D-type flip-flop (hereinafter, a DF/F) at the leading edge of the clock signal CK (see the data-latching timing chart in FIGS. 14(*a*) through 14(*c*)).

Subsequently to this, the latched display data D is supplied to the sampling memory circuit 1303 constituted by a DF/F, where it is synchronized the leading edge of output signals (SR1, SR2, . . . SRn) and stored. The output signals (SR1, SR2, . . . SRn) are provided by the n stages in the shift register circuit 1302 as results of the transmission of the start pulse signal SP through these n stages at the leading edge of the clock signal CK. The display data D is subsequently supplied to the hold memory circuit 1304 and then provided as output signals by the hold memory circuit 1304 according to the latch signal LS, so that the hold memory circuit 1304 can hold the output signals until it receives a next latch signal LS.

However, in this conventional case, an attempt to improve the resolution of the liquid crystal panel 901 to eventually achieve an improvement in the quality of displayed images inevitably leads to degradation of the quality of displayed images. Specifically, in a case when the liquid crystal panel 901 is a conventional SXGA (Super extended Graphics Array; 1024×RGB×768) which requires 18 sets of RGB-compatible display data D (6 bits×RGB), as an example, the source driver 902, for example, needs to transfer the display data D at an extremely high data transfer rate of 65 MHz which would be derived from the clock signal CK, so as to effect a 64 tone display.

Therefore, in the conventional case, an attempt to achieve an improved resolution with the liquid crystal panel 901 requires that the input latch circuit 1301 sequentially latch the display data D at a higher transfer rate and the sampling memory circuit 1303 store the latched display data D as a time series. The higher transfer rate, however, makes it difficult to ensure the specifications (data setup/hold time) of the clock signal CK from which timings are obtained for the picking-up of the display data D.

For these reasons, in the conventional case, the quality of displayed images deteriorates due to a higher frequency of the clock signal CK corresponding to a higher data transfer rate, which entails a problem that improvement cannot be made simultaneously in both the resolution-and the quality of displayed images.

SUMMARY OF THE INVENTION

In view of these problems with conventional cases, the present invention has an object to offer semiconductor devices, having an extended operating frequency range and improved reliability, which operate on a clock frequency reduced to half the required data transfer rate, for example, by the use of an input interface section capable of picking up the display data D both at the leading and trailing edges of the clock signal and the source drivers capable of internally carrying out serial-to-parallel conversion, and another object to offer display modules incorporating such a semiconductor device.

In order to solve the aforementioned problems, a semiconductor device in accordance with the present invention includes:

transfer means for transferring a start pulse signal derived from a clock signal;

latch means for picking up an incoming display data signal in synchronism with the clock signal and outputting the display data signal as synchronous data; and sampling means for sampling and outputting the synchronous data according to the transferred start pulse signal, wherein the latch means is provided to pick up the display data signal at both a leading edge and a trailing edge of the clock signal.

Therefore, in the arrangement, the provision of the latch means and the sampling means enables the serial-to-parallel conversion and eventual output of the display data signal to effect a display. Further, in the arrangement, the latch means is provided to pick up the display data signal at both the leading and trailing edges of the clock signal; therefore, the clock frequency of the clock signal can be reduced relative to the data transfer rate required for the display data signal. Thus, the arrangement makes it easier to ensure the specifications (data setup/hold time) of the clock signal CK from which timings are obtained for the picking-up of the display data. Therefore, the arrangement can achieve improvement simultaneously in both the resolution and the quality of displayed images, while avoiding the deterioration of the quality of displayed images.

In order to solve the aforementioned problems, another semiconductor device in accordance with the present invention includes:

transfer means for transferring a start pulse signal derived from a clock signal;

latch means for picking up an incoming display data signal in synchronism with the clock signal and outputting the display data signal as synchronous data; and sampling means for sampling and outputting the synchronous data according to the transferred start pulse signal, wherein the latch means is provided to pick up the display data signal at both leading edges and trailing edges of a plurality of clock signals that are out of phase from one another.

In the arrangement, the latch means is provided to pick up the display data signal at both the leading and trailing edges of the plurality of clock signals that are out of phase from one another; therefore, the clock frequency of the clock signals can be reduced further relative to the data transfer rate of the display data signal. Thus, the arrangement makes it easier to ensure the specifications (data setup/hold time) of the clock signal CK from which timings are obtained for the picking-up of the display data. Therefore, the arrangement can achieve improvement simultaneously in both the resolution and the quality of displayed images, while avoiding the deterioration of the quality of displayed images.

A display module in accordance with the present invention, as described above, includes any one of the foregoing semiconductor devices. With the arrangement, the display module provides a versatile and reliable solution to improvement of the resolution and the quality of displayed images.

The present invention will become more fully understood from the detailed description given hereinbelow and the accompanying drawings which are given by way of illustration only, are not in any way intended to limit the scope of the claims of the present invention.

DESCRIPTION OF THE EMBODIMENTS

Referring to FIG. 1 through FIG. 10, the following description will discuss semiconductor devices, as well as display modules incorporating the same, in accordance with embodiments of the present invention.

Figure 2:
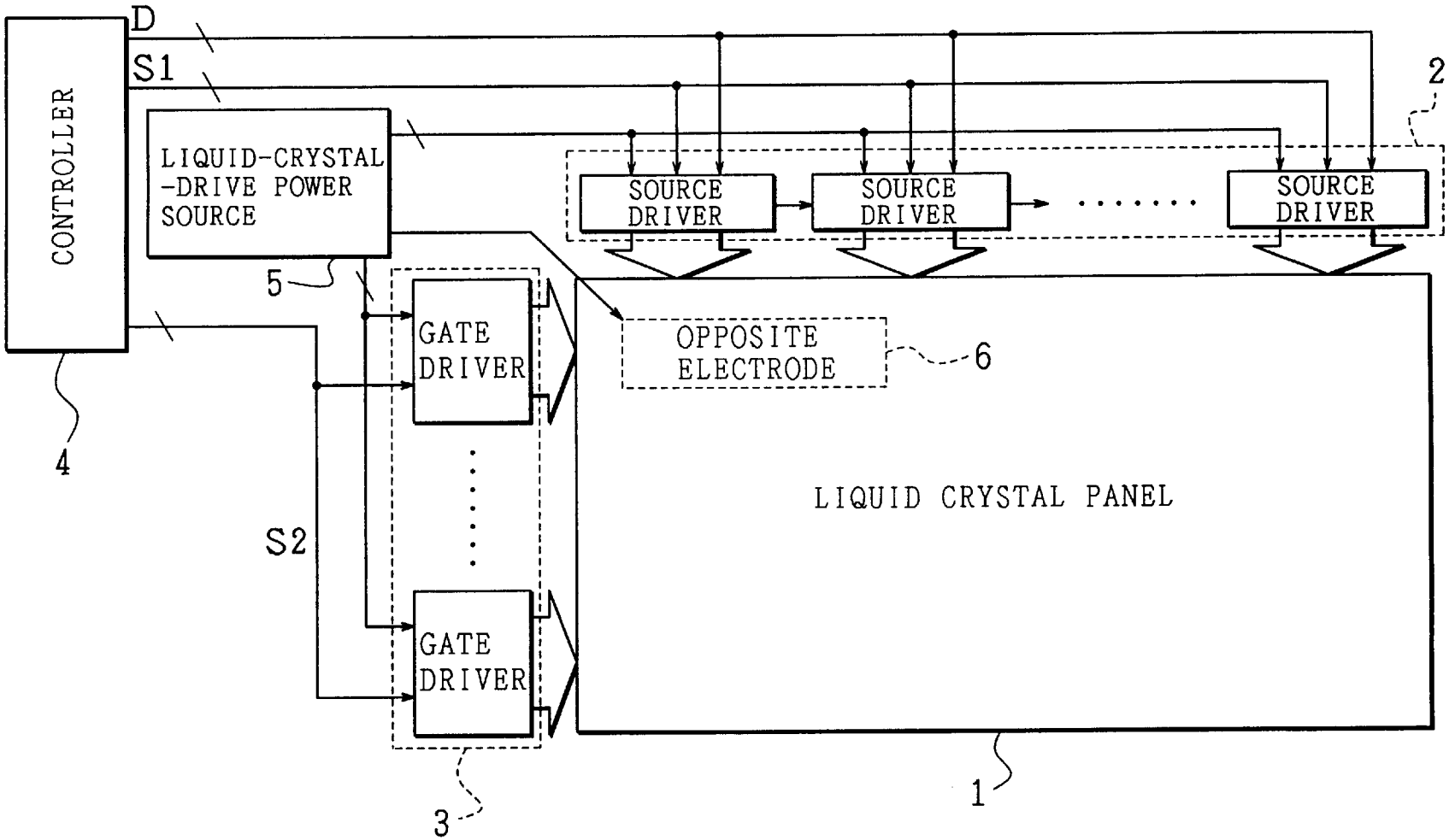
FIG. 2 is a block diagram showing the liquid crystal display device.

Liquid crystal display devices as the aforementioned display modules each include: a liquid crystal panel 1 as a liquid crystal display section based on a TFT (thin film transistor) scheme; and liquid crystal drive devices (semiconductor devices) for driving them, as shown in, for example, FIG. 2. The liquid crystal panel 1 is a typical example that works via an active matrix method. Explanation will be given later regarding the details of the liquid crystal panel 1.

The liquid crystal drive device includes source drivers 2, gate drivers 3, a controller 4, and a liquid-crystal-drive power source 5. Each of the source and gate drivers 2 and 3 includes an integrated circuit. The controller 4 provides display data D and a control signal S1 to the source drivers 2 and a control signal S2 to the gate drivers 3. The control signal S1 may be a horizontally synchronized signal or a clock signal, for example. The control signal S2 may be a vertically synchronized signal, for example.

The output terminal for a liquid-crystal-drive voltage of each source driver 2 is coupled to an associated source signal line 14 of the liquid crystal panel 1. The output terminal for a liquid-crystal-drive voltage of each gate driver 3 is coupled to an associated gate signal line 15 of the liquid crystal panel 1 (see FIG. 3). The liquid-crystal-drive power source 5 supplies, to the liquid crystal drive devices (source and gate drivers 2 and 3), power to drive the liquid crystal drive devices and also various drive voltages which will be applied to the liquid crystal panel 1.

In the liquid crystal drive device, the source and gate drivers 2 and 3 are mounted, for example, to TCP (Tape Carrier Packages; not shown). The TCP refers to a thin package in which an LSI circuit is attached to a tape film. The output terminal side of the TCP is electrically bonded, using thermal compression, to the terminals (not shown) of the liquid crystal panel 1, for example, via an ACF (Anisotropic Conductive Film). The terminals are fabricated from ITO (Indium Tin Oxide) on a liquid crystal glass substrate (not shown) in the liquid crystal panel 1 and connected to the source signal lines 14 and the gate signal lines 15.

Meanwhile, the inputs and outputs of the input side signal to the source drivers 2 and the gate drivers 3 are effected via TCP wiring, flexible substrate wiring, etc. Digital display data which is externally provided in a serial format is transmitted through the controller 4 and supplied to the source driver 2 as serial display data D.

Figure 1:
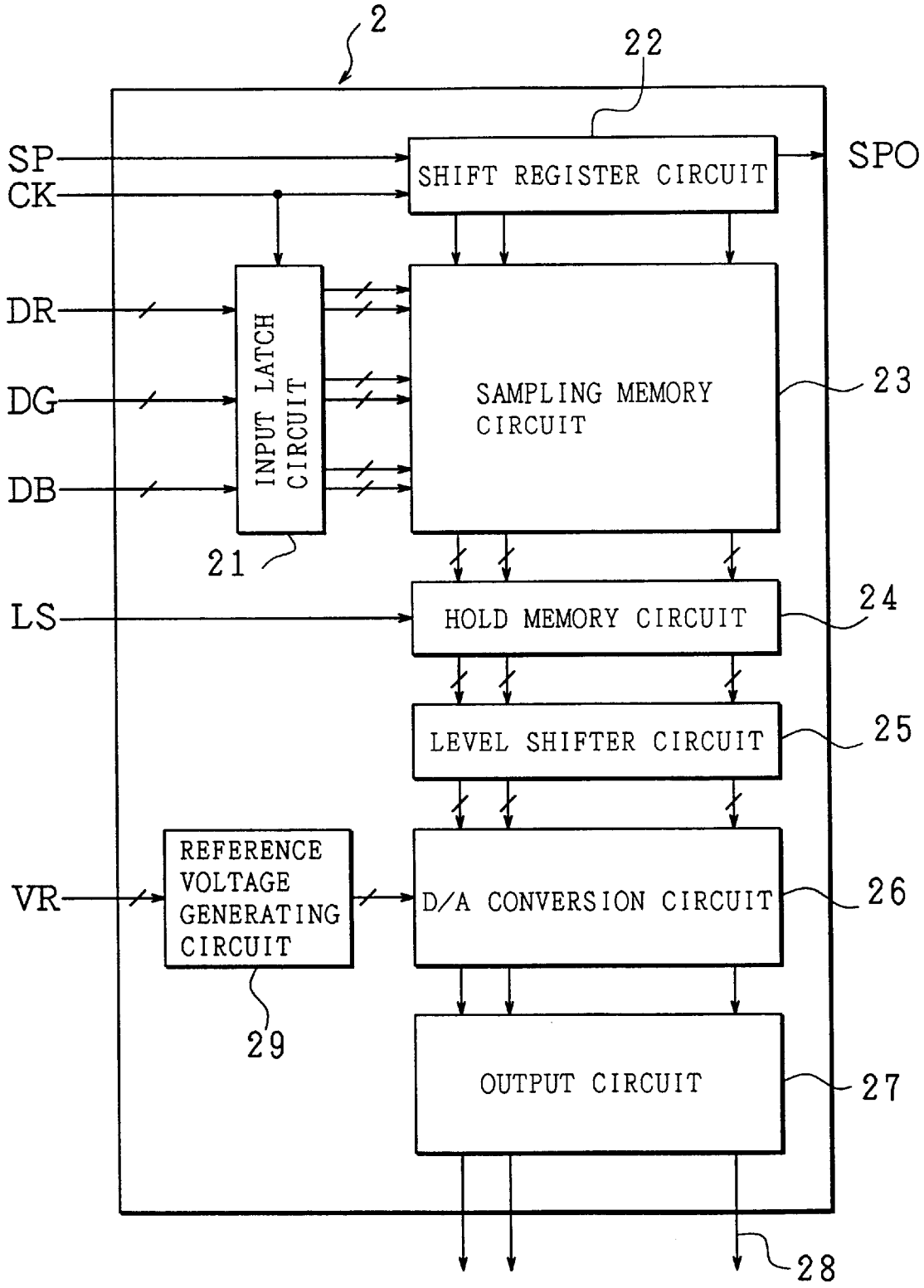
FIG. 1 is a block diagram showing a source driver in accordance with embodiment 1 of the present invention, which is used to drive a liquid crystal display device as a display module of the present invention.

FIG. 1 shows an example of a circuit block diagram showing the source driver 2 in accordance with embodiment 1 of the present invention. The source driver 2 primarily includes a shift register circuit (transfer means) 22, an input latch circuit (latch means) 21, a sampling memory circuit (sampling means) 23, a hold memory circuit 24, a level shifter circuit 25, a D/A conversion circuit 26, an output circuit 27, output terminals 28 for the output circuit 27, and a reference voltage generating circuit 29. In the following description, the circuit structure will be first discussed regarding its differences from conventional technologies. The other operations of the circuit will be explained later.

Figure 12:
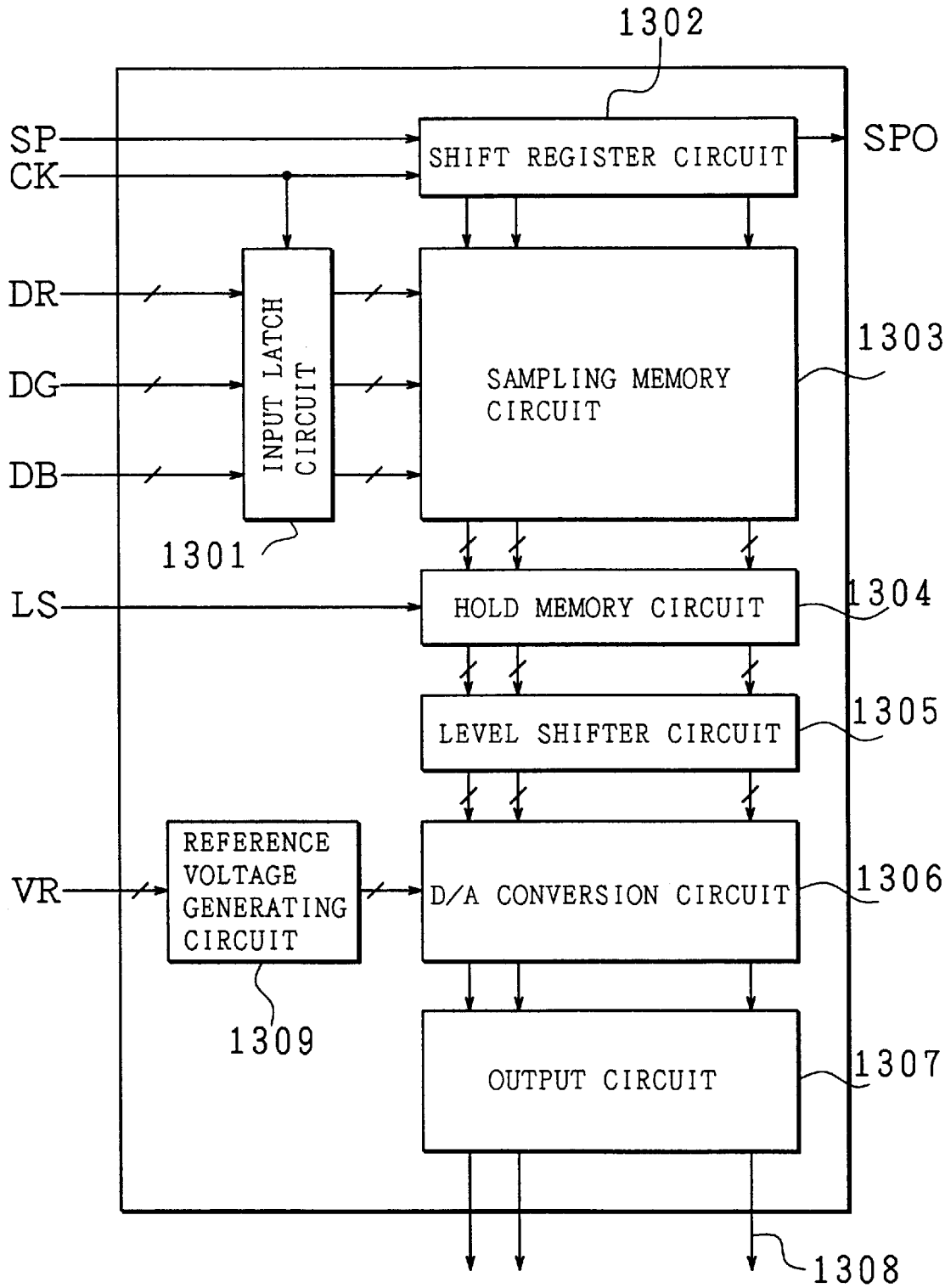
FIG. 12 is a block diagram showing a source driver for use in the liquid crystal display device.
Figure 13:
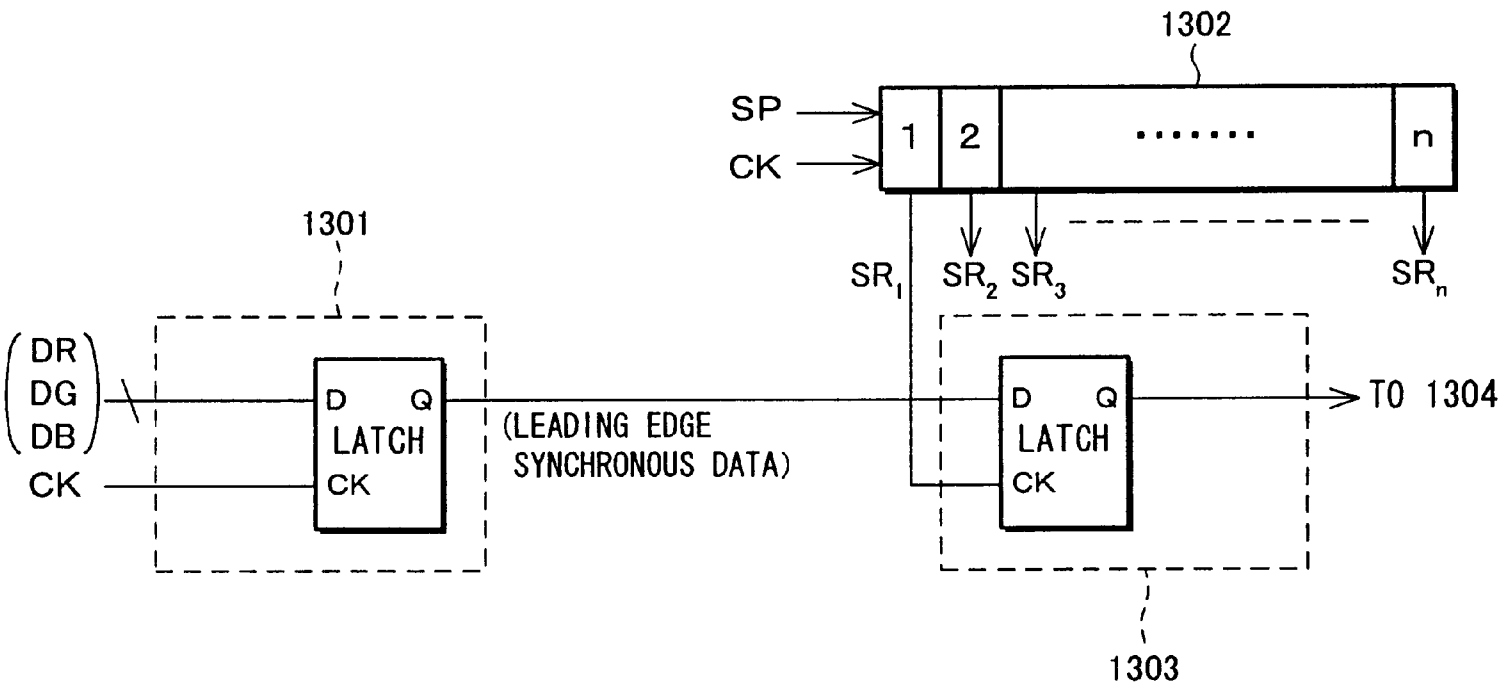
FIG. 13 is a block diagram showing a major part of the source driver.
Figure 14:
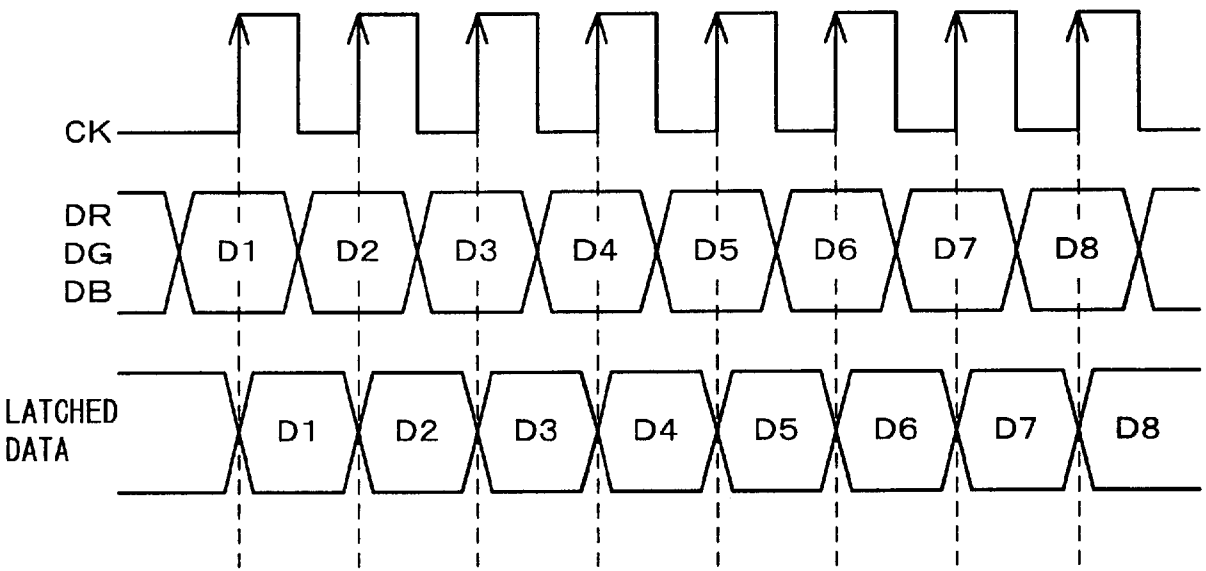
FIGS. 14(*a*) through 14(*c*) are timing charts showing an operation by the source driver.

The differences can be found in the aspects detailed below. In the conventional case, as shown in FIG. 12 and FIG. 13, the input latch circuit 1301 latches input display data D; the sampling memory circuit 1303 plays a central role in picking up and transferring the display data D; and a DF/F is provided for each bit of the digital display data D composed of three kinds of 6-bit data DR, DG,. and DB (18 bits in the total), the input latch circuit 1301 being constituted by these DF/Fs.

In contrast, in the embodiment 1 of the present invention, the input latch circuit 21 latches the display data D according to both the leading and trailing edges of the clock signal CK, so that the display data D can be processed in subsequent circuits in a shorter time, that is, at a higher rate (higher data transfer rate), than in conventional cases with respect to the clock frequency of the clock signal CK.

Figure 4:
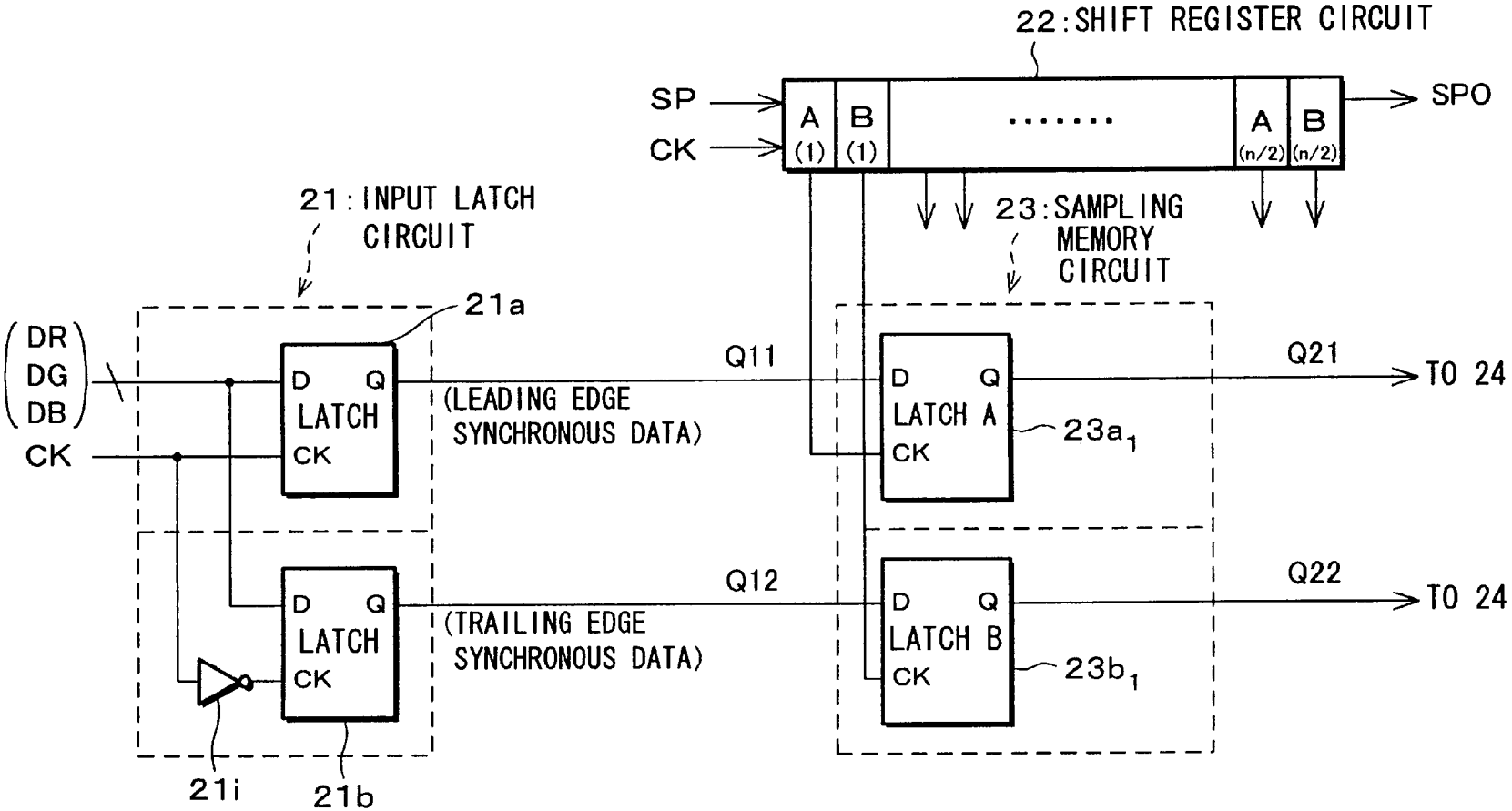
FIG. 4 is a block diagram showing a major part of the source driver.
Figure 5:
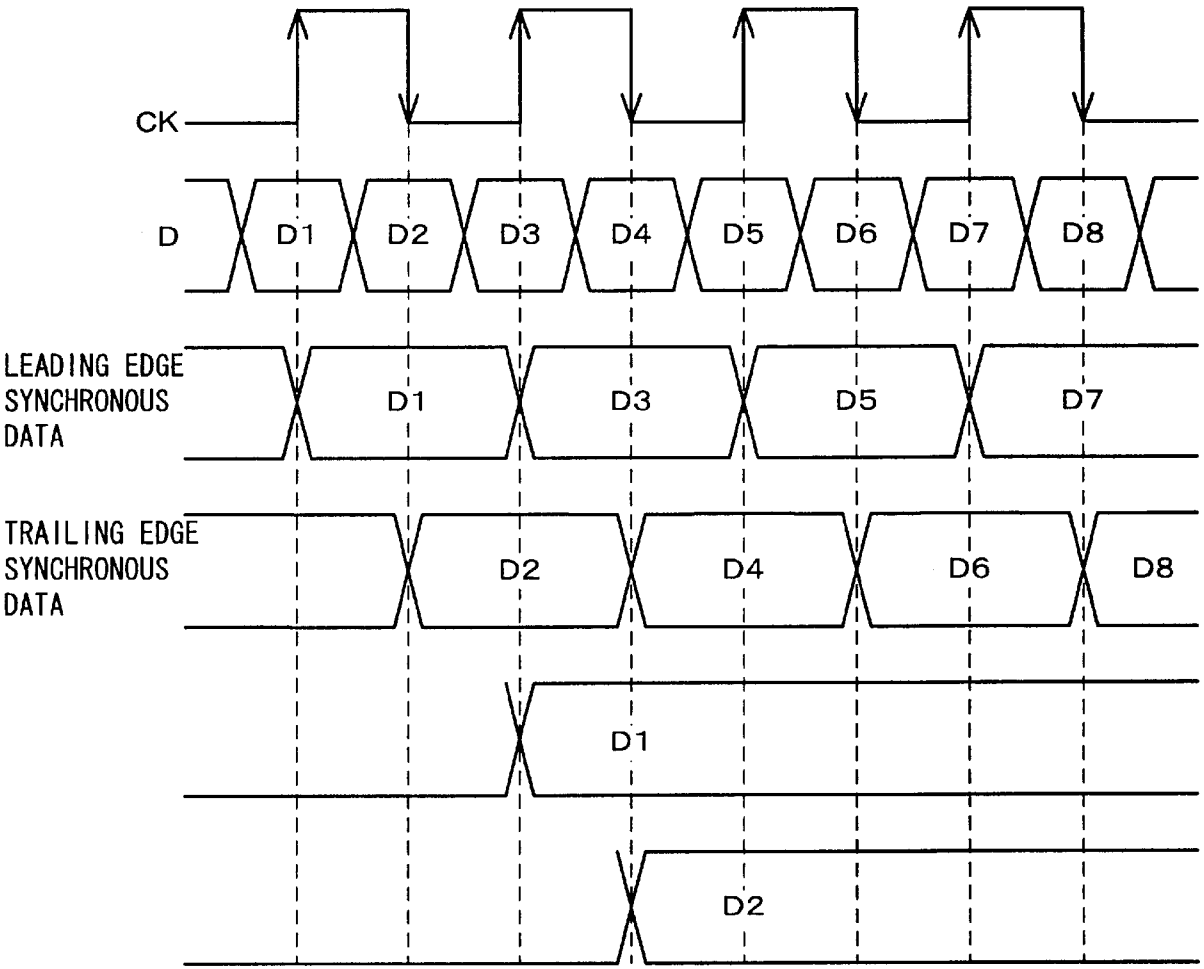
FIGS. 5(*a*) through 5(*f*) are timing charts showing an operation for the source driver to pick up display data D.

Now, referring to the circuit example of FIG. 4 and the timing charts of FIGS. 5(*a*) through 5(*f*), the following description will discuss embodiment 1 of the present invention. The input latch circuit 21 picks up each bit of the serial display data D composed of three kinds of 6-bit data DR, DG, and DB (18 bits in the total), which are supplied from the controller 4, in synchronism with either the leading or trailing edge of the clock signal CK and then provides synchronous sets of data Q11 and Q12 respectively.

To perform this task, the input latch circuit 21 includes two DF/Fs: namely, DF/F21*a* and DF/F21*b*. DF/F21*a* receives the display data D and the clock signal CK. DF/F21*b* receives the display data D and a reverse clock signal $\overline{CK}$ derived by reversing the clock signal CK using an inverter 21*i*. The display data D is fed to DF/F21*a* and DF/F21*b* through their D-terminals. The clock signal CK and the reverse clock signal $\overline{CK}$ are fed to DF/F21*a* and DF/F21*b* through their CK terminals.

The sampling memory circuit 23 includes DF/F23$a_1$ and DF/F23$b_1$ which receive and latch the two outputs of the input latch circuit 21, i.e., the synchronous data Q11 and Q12 respectively.

The output of the A(1)-th stage in the shift register circuit 22 is coupled to the CK terminal of DF/F23$a_1$ which receives the leading edge synchronous data Q11. Meanwhile, the output of the B(1)-th stage in the shift register circuit 22 is coupled to the CK terminal of DF/F23$b_1$ which receives the trailing edge synchronous data Q12.

Incidentally, the shift register circuit 22 with n stages is constituted by shift register sections A(1), A(2), . . . , and A(n/2) that sequentially pass the start pulse signal SP on from one to a next in synchronism with the leading edges of the clock signal CK and shift register sections B(1), B(2), . . . , and B(n/2) that sequentially pass the start pulse signal SP on from one to a next in synchronism with the trailing edges of the clock signal CK.

The outputs Q21 and Q22 of the sampling memory circuit 23 are fed and stored in predetermined addresses in the hold memory circuit 24. FIG. 4 shows a circuit corresponding to a bit (for example, DR1) of the serial display data D composed of three kinds of 6-bit data DR, DG, and DB (18 bits in the total), and further shows, as a typical example, a part of the shift register circuit 22 which performs sampling at the timings of the A(1)-th and B(1)-th stages.

Although not shown in the diagram, the output Q11 of the input latch circuit 21 to which the display data DR1 is supplied is supplied commonly to DF/F23$a_2$ through DF/F23$a_{n/2}$ in the sampling memory circuit 23. The outputs of the remaining A(2)-th through A(n/2)-th stages in the shift register circuit 22 are supplied to the respective CK terminals of DF/F23$a_2$ through DF/F23$a_{n/2}$. The outputs of the sampling memory circuit 23 are fed and stored in predetermined addresses in the hold memory circuit 24.

Meanwhile, the output Q12 of the input latch circuit 21 to which the display data DR1 is supplied is supplied commonly to DF/$Fb_2$ through DF/$Fb_{n/2}$ in the sampling memory circuit 23. The outputs of the remaining B(2)-th through B(n/2)-th stages in the shift register circuit 22 are supplied to the respective CK terminals of DF/$Fb_2$ through DF/$Fb_{n/2}$. The outputs of the sampling memory circuit 23 are fed and stored in predetermined addresses in the hold memory circuit 24.

The above description discussed a circuit structure and processing example of the display data DR1. There are provided circuit structures to process other sets of display data constituting the display data D in similar manners, so that those sets are processed similarly. The display data D is thus converted from serial to parallel.

FIGS. 5(*a*) through 5(*f*) show various timing charts for the clock signal CK and the display data D. The input display data D (see FIG. 5(*b*)) is latched at both the leading and trailing edges of the clock signal CK (see FIG. 5(*a*)) and divided into two channels: namely, the leading edge latched data (see FIG. 5(*c*)) and the trailing edge latched data (see FIG. 5(*d*)), that is, the leading edge synchronous data Q11 and the trailing edge synchronous data Q12 respectively.

Therefore, the items of display data D are converted from serial to parallel in pairs. In other words, parallel data is produced with double the original data length in a single conversion cycle. A special remark is made here about the fact that the clock frequency of the clock signal CK is half the data transfer rate of the display data D. If the data transfer rate equals 80 MHz, the clock frequency equals 40 MHz.

As detailed above, in the present invention, the clock frequency is reduced to half the data transfer rate of the display data D required to effect a display, because the display data D is picked up and processed at both the leading and trailing edges of the clock signal CK. The present invention thus can offer liquid crystal drive devices (semiconductor devices) having an extended operating frequency and improved reliability, as well as liquid crystal display modules incorporating such a liquid crystal drive device.

Figure 6:
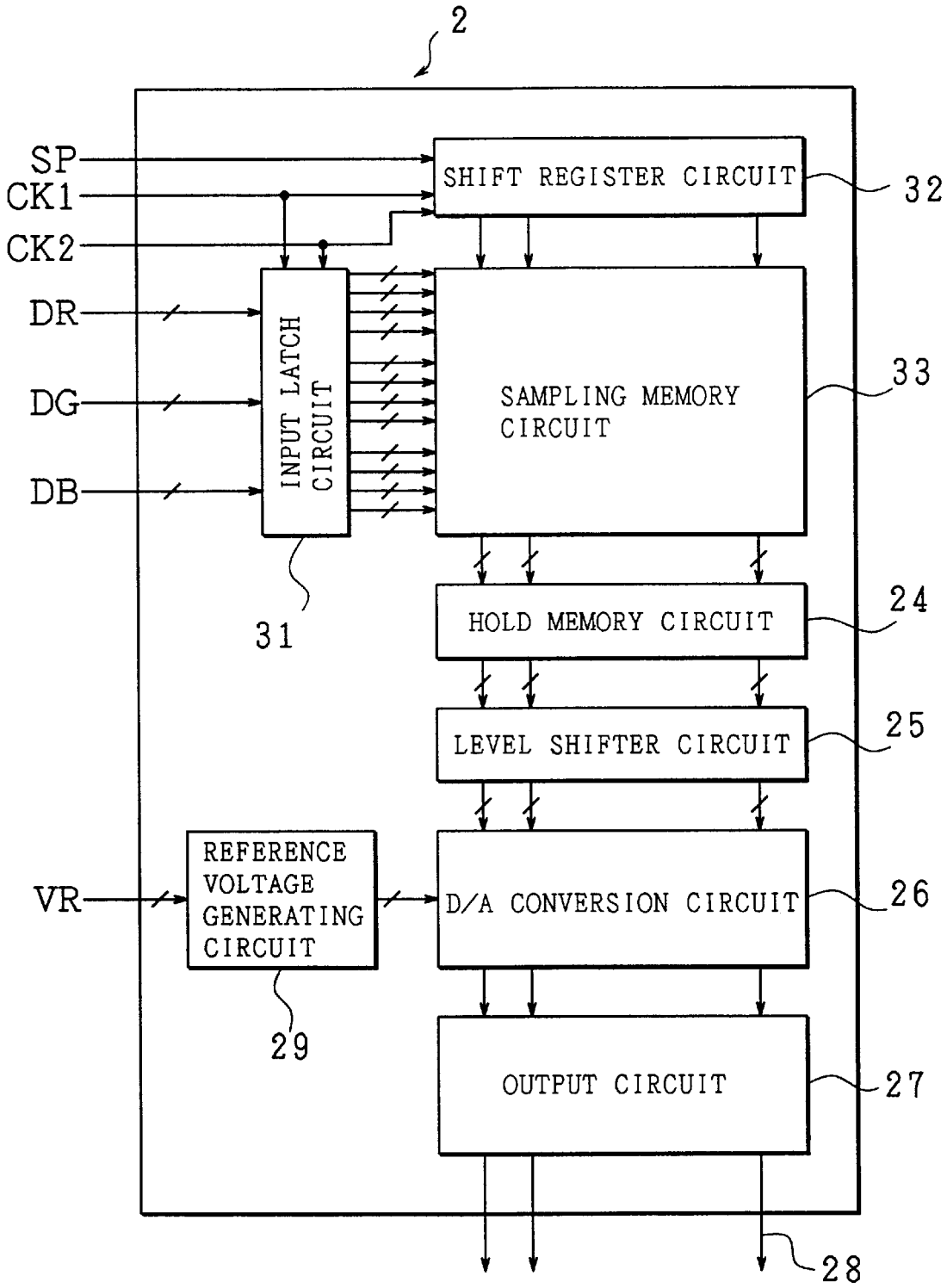
FIG. 6 is a block diagram showing a source driver in accordance with embodiment 2 of the present invention.
Figure 7:
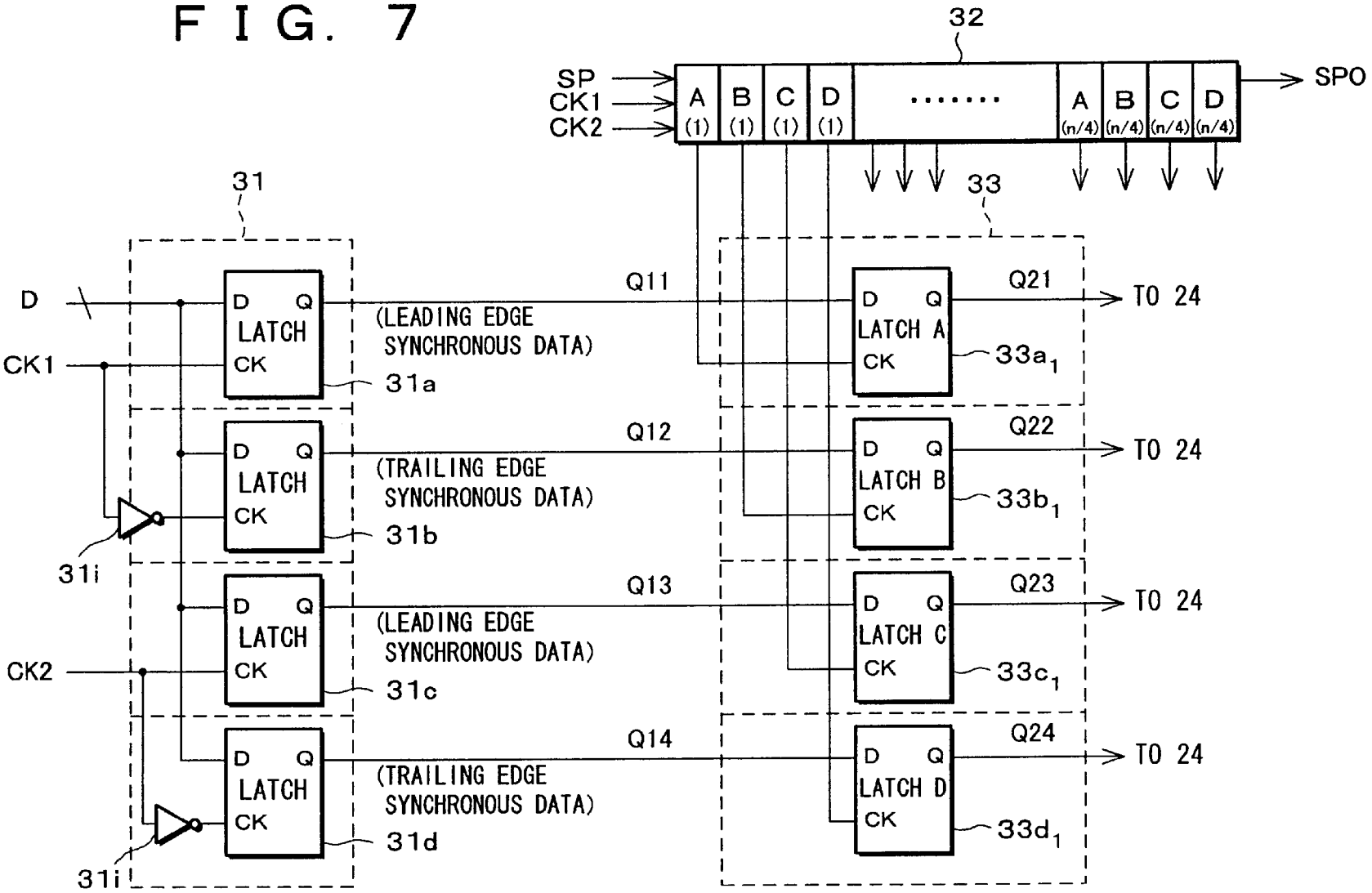
FIG. 7 is a block diagram showing a major part of the source driver.
Figure 8:
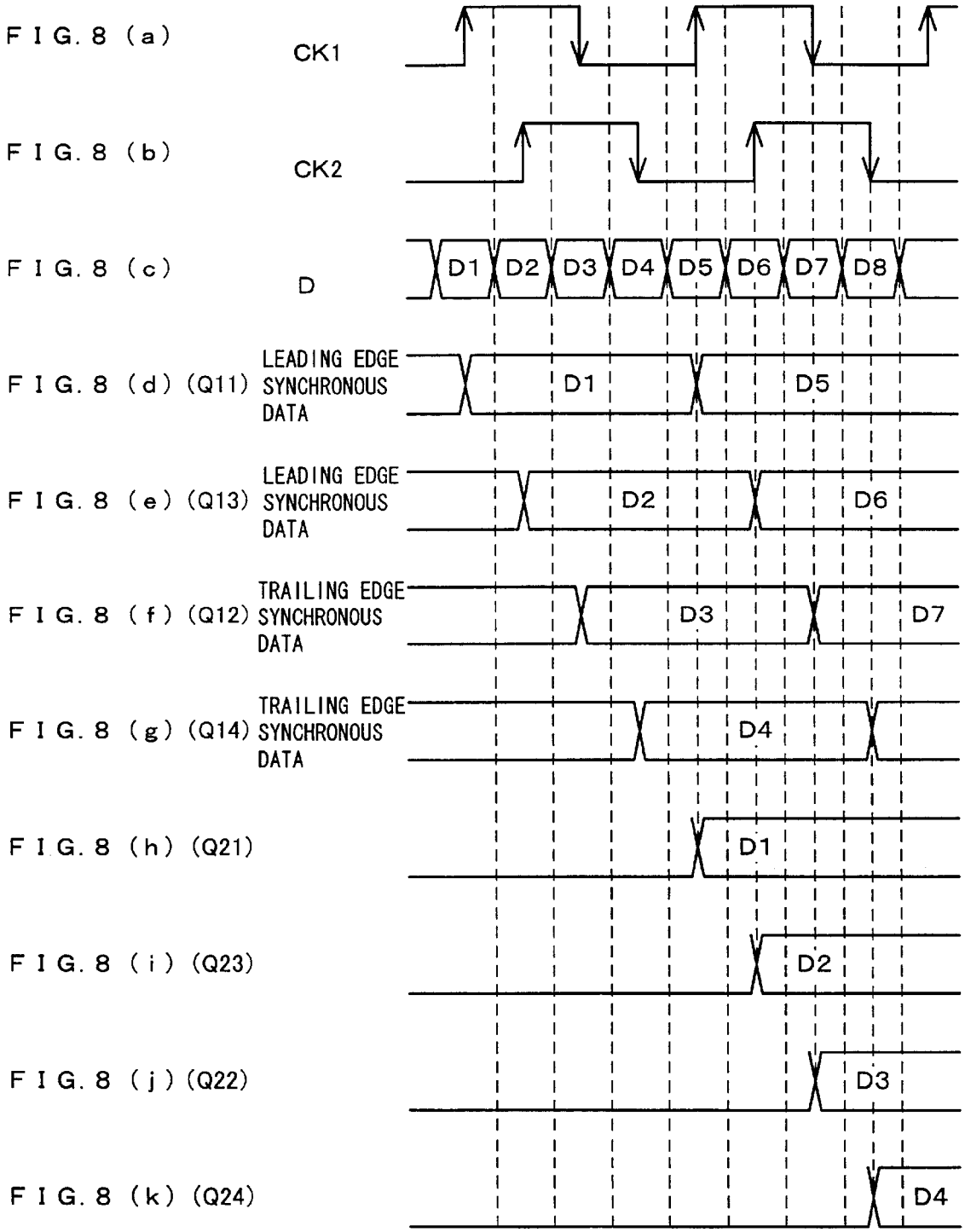
FIGS. 8(*a*) through 8(*k*) are a timing charts showing an operation for the source driver to pick up display data D.

Now, referring to FIG. 6 through FIGS. 8(*a*) through 8 (*k*), the following description will discuss another embodiment (embodiment 2) of the present invention.

In embodiment 1 above, the controller 4 supplied a single phase clock signal CK. In this case, an attempt to further improve the resolution, whereby the display data D is latched in the input latch circuit 21 at a further increased data transfer rate and stored in the sampling memory circuit 23 as a time series, may make it difficult to ensure the specifications (data setup/hold time) of the clock signal CK from which timings are obtained for the picking-up of the display data D.

Accordingly, in the liquid crystal drive device as a semiconductor device in accordance with embodiment 2, as shown in FIGS. 6, 7 and 8(*a*) through 8(*k*), two clock signals CK1 and CK2 which are 90' out of phase are used in the picking-up and processing of the display data D by the input latch circuit 31, the shift register circuit 32 and the sampling memory circuit 33 which are processing circuits compatible with the data pick-up at both the leading and trailing edges. The arrangement can reduce the clock frequency to a quarter of the required data transfer rate for the display data D. The arrangement can, eventually, offer liquid crystal drive devices (semiconductor devices) having an extended operating frequency and improved reliability, as well as liquid crystal display modules incorporating such a liquid crystal drive device.

FIG. 7 is a circuit diagram showing a source driver 2 in accordance with embodiment 2. Major differences from the source driver 2 of FIG. 1 lie in that in embodiment 1 a single phase clock signal CK was supplied to the input latch circuit 21 which latches the display data D, whereas in embodiment 2 two clock signals CK1 and CK2 which are out of phase are supplied to the input latch circuit 31.

Now, the explanation immediately below will focus on the input latch circuit 31, the sampling memory circuit 33, and the shift register circuit 32. The hold memory circuit 24, the level shifter circuit 25, the D/A conversion circuit 26, the output circuit 27, and the reference voltage generating circuit 29 in embodiment 2 have the same arrangement and function as those in embodiment 1 above and are indicated by the same reference numerals and description thereof is omitted.

FIG. 7 shows, as an example, a circuit diagram of the input latch circuit 31, the sampling memory circuit 33, and the shift register circuit 32 in accordance with the present invention, and FIGS. 8(*a*) through 8(*k*) show timing charts. In embodiment 2, the input latch circuit 31 latches the display data D at both the leading and trailing edges of the two clock signals CK1 and CK2 which are 90' out of phase, to enable subsequent circuits to take less time in processing the display data D.

A more detailed explanation will be now given to the embodiment 2 in reference to FIG. 7 and FIGS. 8(*a*) through 8(*k*). The input latch circuit 31 has four DF/Fs for receiving the display data D at their D-terminals each of which serves as an input terminal for an associated bit of the display data D composed of three kinds of 6-bit data DR, DG, and DB (18 bits in the total) supplied by the controller 4. The four DF/Fs are, namely, DF/F31*a*, DF/F31*b*, DF/F31*c*, and DF/F31*d*. DF/F31*b* uses a reverse clock CK1 which has been obtained by reversing the clock signal CK1 using the inverter 31*i*. DF/F31*c* and DF/F31*d* are arranged to operate with the clock signal CK2 in the same manner as DF/F31*a* and DF/F31*b* are arranged to operate with the clock signal CK1 that is 90' out of phase.

The sampling memory circuit 33 has four DF/F33$a_1$, DF/F33$b_1$, DF/F33$c_1$, and DF/F33$d_1$ which receive and latch the four outputs Q11, Q12, Q13, and Q14 of the input latch circuit 31.

The output of the A(1)-th stage in the shift register circuit 32 is coupled to the CK terminal of DF/F33$a_1$ which receives the leading edge synchronous data Q11 at its D-terminal. Meanwhile, the output of the B(1)-th stage in the shift register circuit 32 is coupled to the CK terminal of DF/F33$b_1$ which receives the trailing edge synchronous data Q12 at its D-terminal.

Further, the output of the C(1)-th stage in the shift register circuit 32 is coupled to the CK terminal of DF/F33$c_1$ which receives the leading edge synchronous data Q13 which is 90' out of phase at its D-terminal. Meanwhile, the output of the D(1)-th stage in the shift register circuit 32 is coupled to the CK terminal of DF/F33$d_1$ which receives the trailing edge synchronous data Q14 at its D-terminal.

Incidentally, the shift register circuit 32 with n stages is constituted by shift register sections A(1), A(2), . . . , and A(n/4) that sequentially pass the start pulse signal SP on from one to a next in synchronism with the leading edges of the clock signal CK1, shift register sections B(1), B(2), . . . , and B(n/4) that sequentially pass the start pulse signal SP on from one to a next in synchronism with the trailing edges of the clock signal CK1, shift register sections C(1), C(2), . . . , and C(n/4) that sequentially pass the start pulse signal SP on from one to a next in synchronism with the leading edges of the clock signal CK2, and shift register sections D(1), D(2), . . . , and D(n/4) that sequentially pass the start pulse signal SP on from one to a next in synchronism with the trailing edges of the clock signal CK2.

The outputs Q21, Q22, Q23, and Q24 of the sampling memory circuit 33 are fed and stored in predetermined addresses in the hold memory circuit 24. FIG. 6 shows a circuit corresponding to a bit (for example, DR1) of the display data D composed of three kinds of 6-bit data DR, DG, and DB (18 bits in the total), and further shows, as a typical example, a part of the shift register circuit 32 which performs sampling at the timings of the A(1)-th, B(1)-th, C(1)-th, and D(1)-th stages.

Although not shown in the diagram, the output synchronous data Q11 of the input latch circuit 31 to which the display data DR1 is supplied is supplied commonly to the D-terminals of DF/F33$a_2$ through DF/F33$a_{n/4}$. Here, the outputs of the remaining A(2)-th through A(n/4)-th stages in the shift register circuit 32 are sequentially supplied to the CK terminals of DF/F33$a_2$ through DF/F33$a_{n/4}$. The outputs of the sampling memory circuit 33 are fed and stored in predetermined addresses in the hold memory circuit 24.

Meanwhile, the output synchronous data Q12 of the input latch circuit 31 to which the display data DR1 is supplied is supplied commonly to the D-terminals of DF/F33$b_2$ through DF/F33$b_{n/4}$ (not shown). Here, the outputs of the remaining B(2)-th through B(n/4)-th stages in the shift register circuit 32 are sequentially supplied to the CK terminals of DF/F33$b_2$ through DF/F33$b_{n/4}$. The outputs of the sampling memory circuit 33 are fed and stored in predetermined addresses in the hold memory circuit 24.

The same description holds true with the output synchronous data Q13 and Q14 of the input latch circuit 31; The outputs Q23 and Q24 are supplied to, and then stored in, the next hold memory circuit 24. The above description discussed a circuit structure and processing example of the display data DR1. There are provided circuit structures to process other sets of display data constituting the display data D in similar manners, so that those sets are processed similarly.

Therefore, in embodiment 2, the items of display data D are converted from serial to parallel in combinations each of which is made of up four of the items. In other words, parallel data is produced with quadruple the data length in a single conversion cycle. A special remark is made here about the fact that the clock frequency is a quarter of the data transfer rate of the display data D. If the data transfer rate equals 80 MHz, the clock frequency equals 20 MHz.

As detailed above, the clock frequency and the data transfer rate of the display data D are reduced to a quarter, because the display data D is picked up and processed at both the leading and trailing edges of the clock signals CK1 and CK2 which are specified to be out of phase from each other. The above arrangement thus can offer liquid crystal drive devices (semiconductor devices) having an extended operating frequency and improved reliability, as well as liquid crystal display modules incorporating such a liquid crystal drive device.

In embodiment 2 so far, the clock signals CK1 and CK2 that were out of phase from each other were taken as an example; however, clock signals CK1 through CKm with m different phases may be used to latch and process the display data D. Particularly, if $m=2^k$ (k=0, 1, 2, 3, . . . ), the arrangement is highly compatible with the subsequent circuit configuration. In this case, the m clock signals CK1 through CKm are preferably specified to be 360°/(2m) out of phase sequentially.

The present invention was explained in terms of liquid crystal drive devices in the foregoing, but is not limited to liquid crystal drive devices. For example, the present invention is applicable to any display device in which one or more semiconductor devices, e.g., the source drivers 2, for driving a display element are connected in cascade and an image is displayed on a screen by repeating the process of transferring the start pulse signal SP in synchronism with the clock signal CK, picking up the display data D according to this transfer signal, and latching the display data D for display with a certain cycle.

The present invention is particularly effective in increasing the display data transfer speed and reliability in an attempt to improve the resolution and extend the dimensions of the display screen of the display device that displays an image on a screen, using drive devices, for example, the foregoing source drivers 2 and gate drivers 3, which are lined in the X- and Y-directions, by repeating the process of transferring the start pulse signal SP in synchronism with the clock signal CK, selecting and picking up the image signal as a time series according to this transfer signal, and latching the image signal for display with a cycle of a horizontally synchronized signal.

Further, the present invention is capable of reducing the operating frequency of the clock signal CK in the semiconductor devices and therefore is adaptable to driving at low voltages, which eventually leads to lower power consumption. Moreover, the present invention can offer semiconductor devices with a high reliability in terms of noise reduction due to lower operating frequencies.

In the foregoing embodiments, it was assumed that the semiconductor device in which the source driver 2 or another chip was disposed on a TCP was mounted, using thermal compression, to the electrode (ITO lines) of the liquid crystal panel 1 via, for example, an anisotropic conductive film (ACF). Alternatively to this TCP mounting, the semiconductor device in accordance with the present invention, as well as the controller 4, may be mounted to an insulating tape that is constituted by a flexible substrate or film.

Alternatively, the present invention may adopt a chip-on-glass (COG) method whereby the semiconductor device is directly mounted as a chip to the electrodes (ITO lines) of the liquid crystal panel 1 via, for example, anisotropic conductive film, using thermal compression. Also, a circuit-in-glass (CIG) method may be alternatively adopted whereby circuits are formed on the glass substrate of the liquid crystal panel 1 using a low temperature polysilicon technique.

Figure 3:
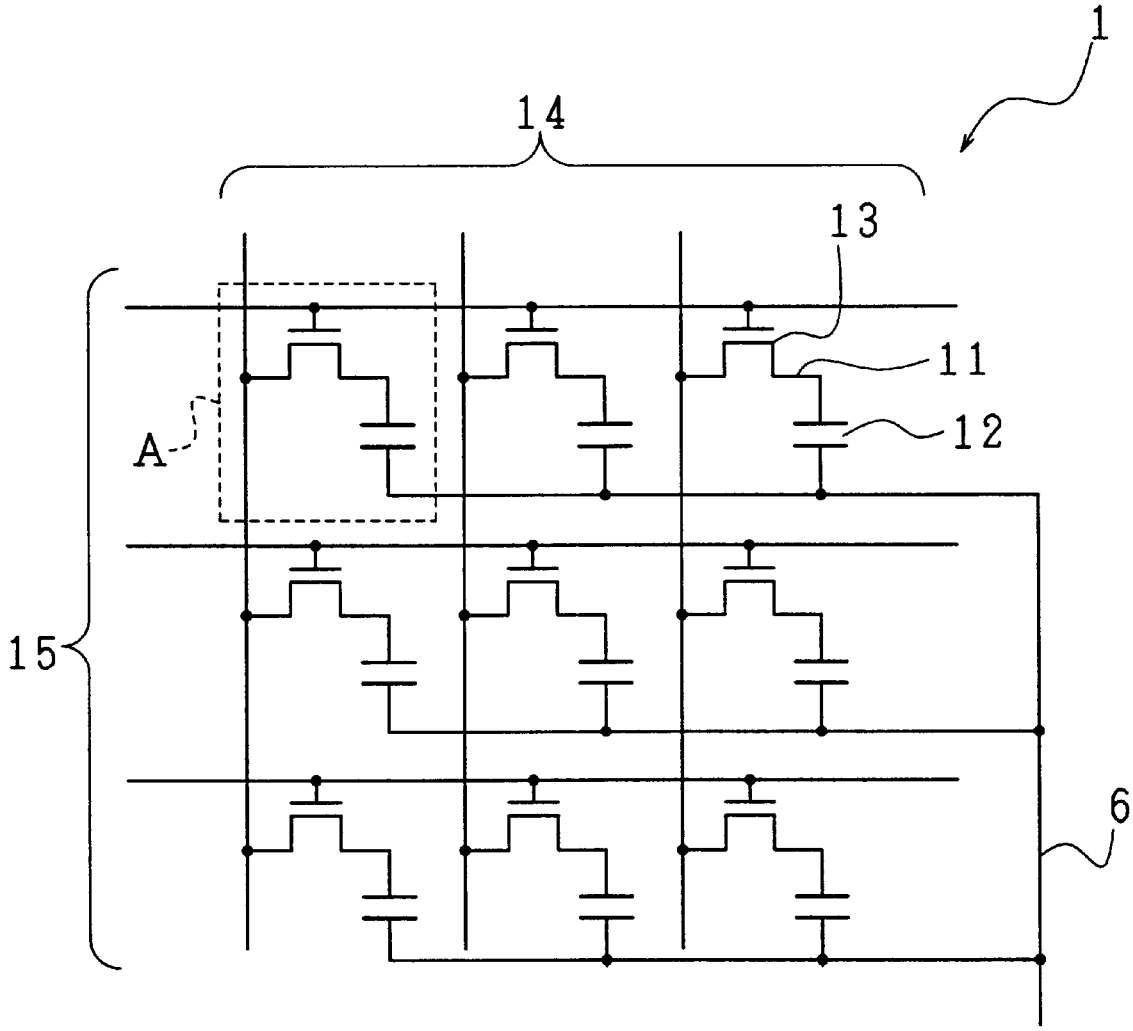
FIG. 3 is a diagram schematically showing the structure of the liquid crystal panel in the liquid crystal display device.
Figure 9:
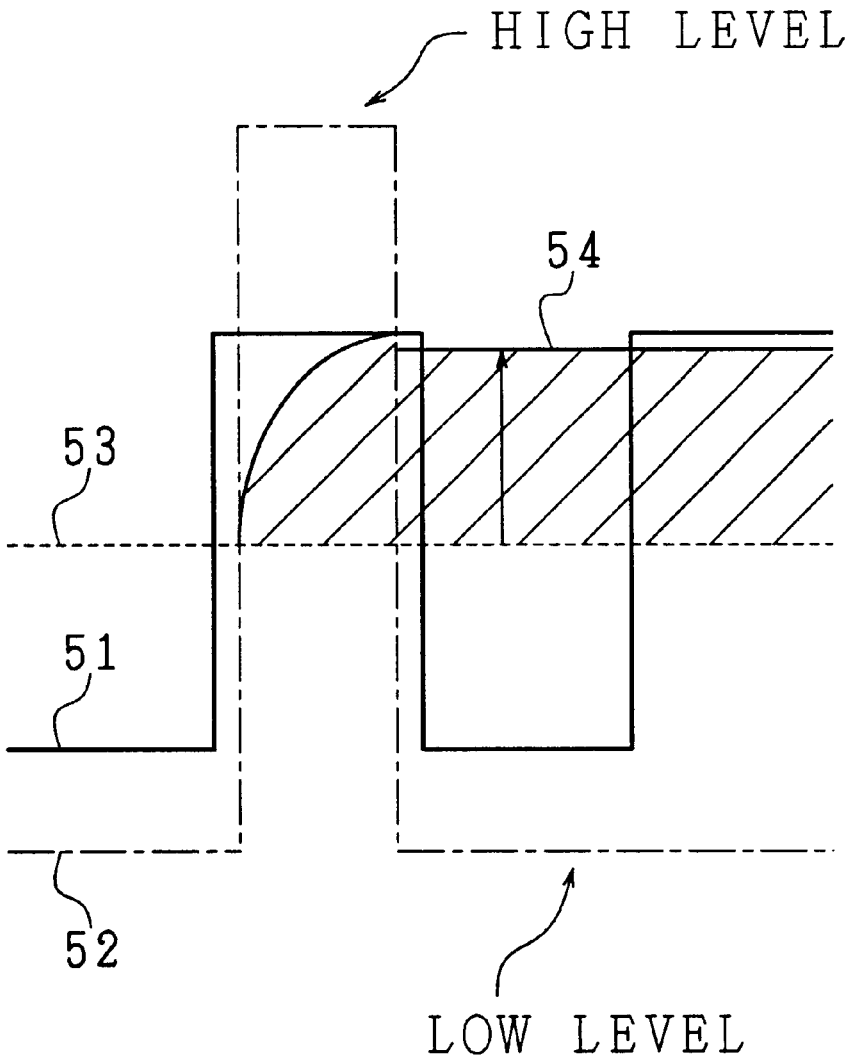
FIG. 9 is a timing chart showing an operation by the liquid crystal panel.
Figure 10:
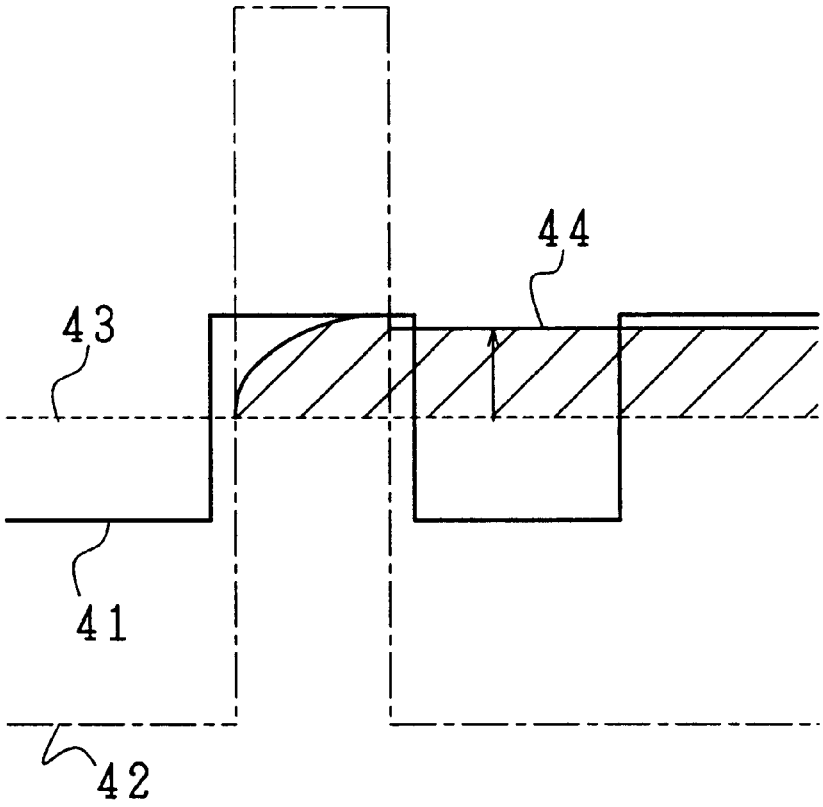
FIG. 10 is a timing chart showing another operation by the liquid crystal panel.
Figure 11:
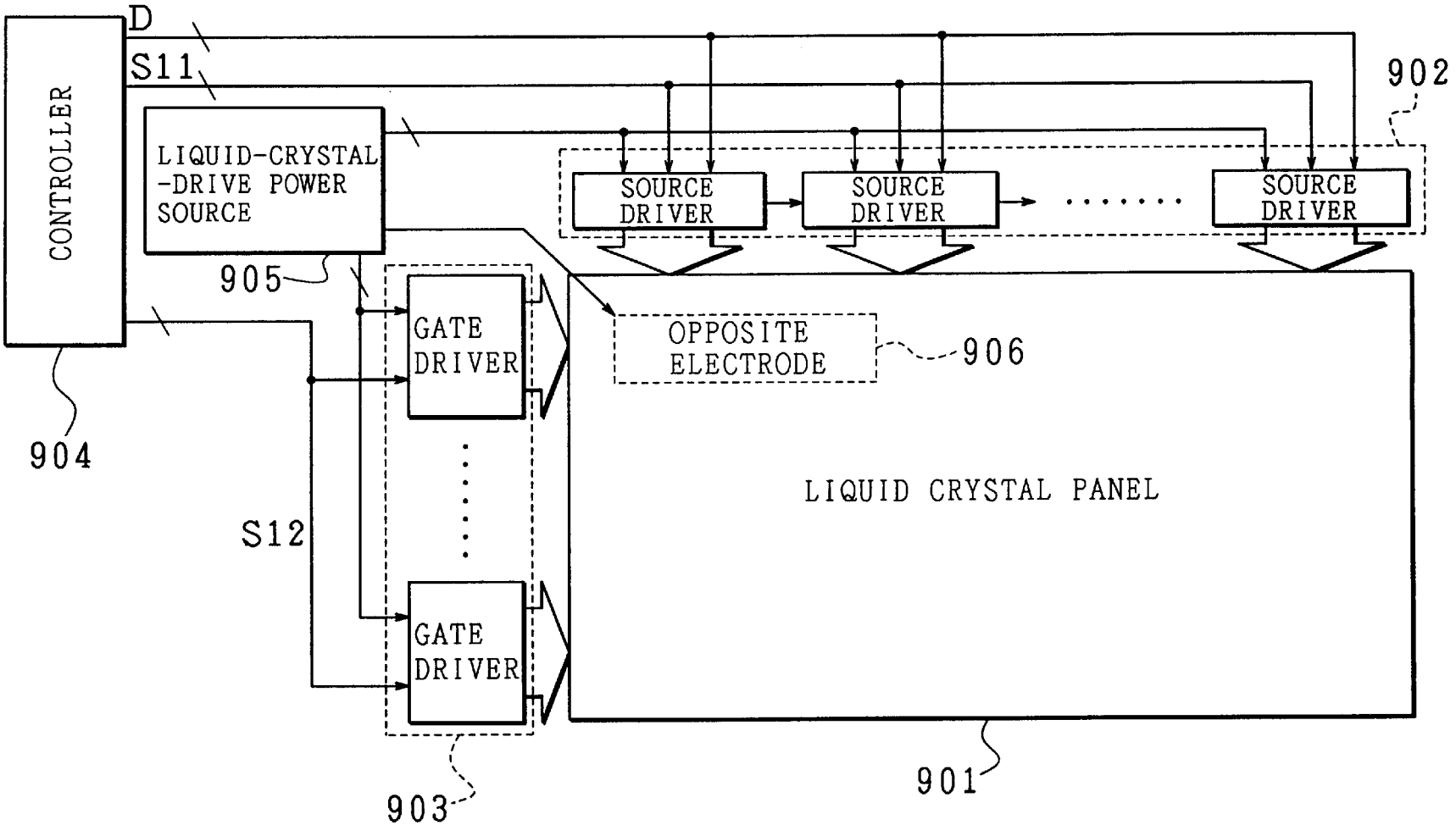
FIG. 11 is a block diagram showing a conventional liquid crystal display device.

Now, the following description will discuss the structure and operation of the aforementioned liquid crystal panel 1 in reference to FIG. 3, FIG. 9, and FIG. 10. The liquid crystal panel 1, as shown in FIG. 3, includes pixel electrodes 11, pixel capacitances 12, TFTs 13 as switching elements for allowing and prohibiting the application of voltage to the pixel electrodes 11, source signal lines 14 to drive the TFTs 13, gate signal lines 15 to drive the TFTs 13, and opposite electrodes 6 disposed across liquid crystal (not shown) from the pixel electrodes 11. In the liquid crystal panel 1, a pixel capacitance 12 is formed across the liquid crystal (not shown) between a pixel electrode 11 and an associated opposite electrode 6.

In FIG. 3, a liquid crystal display element for a single pixel is denoted as "A". The source driver 2 of FIG. 2 applies a tone display voltage representative of one of 64 tones, for example, to the source signal line 14 in accordance with the brightness of the pixel used in the display. The gate driver 3 applies a scanning signal via the gate signal lines 15 to the gates of the TFTs 13 so that the TFTs 13 lined along a longitudinal direction are activated sequentially.

The voltage at the source signal line 14 is applied via an activated TFT 13 to the pixel electrode 11 that is connected to the drain of that TFT 13, so that electric charges accumulate in the pixel capacitance 12 formed between the pixel electrode 11 and the opposite electrode 6. The optical transmittance of the liquid crystal varies depending on the amount of electric charges, which effects a tone display at that pixel.

FIG. 9 and FIG. 10 show, as an example, waveforms to drive a liquid crystal display element and a pixel to effect a display of different tones (for example, a white display and a black display). As shown in FIG. 9 and FIG. 10, the drive waveform 51 and the drive waveform 41 represent the outputs that appear at the output terminal for a liquid-crystal-drive voltage of the source driver 2 and that are fed to the source signal line 14. The drive waveform 52 and the drive waveform 42 represent the outputs that appear at the output terminal for a liquid-crystal-drive voltage of the gate driver 3 and that are fed to the gate signal line 15.

The electric potential 53 and the electric potential 43 represent the electric potential of the opposite electrode 6. The application voltage 54 and the application voltage 44 represent voltages applied to the pixel electrode 11. Thus, the voltage applied across the liquid crystal equals the difference in the voltage between the pixel electrode 11 and the opposite electrode 6 and is denoted by the height of the hatched area in the figures.

For example, in FIG. 9, the TFT 13 is activated when the drive waveform 52 that appear at the output terminal for a liquid-crystal-drive voltage of the gate driver 3 is at high level. The difference in the electric potential between the drive waveform 51 that appear at the output terminal for a liquid-crystal-drive voltage of the source driver 2 and the electric potential 53 of the opposite electrode 6 is applied to the pixel electrode 11. Subsequently, the drive waveform 52 that appear at the output terminal for a liquid-crystal-drive voltage of the gate driver 3 changes to low level, deactivating the TFT 13. Here, since the pixel has the pixel capacitance 12, the voltage applied thereto remains.

The same description holds true with the case in FIG. 10. FIG. 9 and FIG. 10 differ from each other in the voltage applied across the liquid crystal constituting the pixel: the application voltage 54 in the case of FIG. 9 is higher than the application voltage 44 in the case of FIG. 10. In this manner, a multitone display is effected using the pixel by applying analogue voltage across the liquid crystal so as to continuously change the optical transmittance of the liquid crystal. The number of tones that can be displayed depends on the number of values that the analogue voltage applied across the liquid crystal can take.

Referring to FIG. 1 and FIG. 3, the following description will now discuss the processing of the display data D after it is fed to, and stored in, the hold memory circuit 24 and subjected to serial-to-parallel conversion.

The display data D is latched according to the latch signal LS derived from the horizontally synchronized signal, when part of the display data D for a single horizontal period is fed to the hold memory circuit 24. The hold memory circuit 24 then holds the display data D until it receives a next latch signal LS, that is, for one horizontal period, before sending out the display data D.

The levels of signals representative of the latched display data D are changed by the level shifter circuit 25 from voltage levels as logic representations (Vcc-GND levels) to those required to drive the liquid crystal (VDD-GND levels), before the display data D is sent out as display signals.

Meanwhile, the reference voltage generating circuit 29 produces, for example, 64 different levels of voltages, based on reference voltages VR (including, for example, Vref1 to Vref9), which will be used to effect a tone display using a potential dividing or another technique. The D/A conversion circuit 26 converts to analogue voltages by selecting one of the 64 voltage levels according to the display data D composed of the three kinds of 6-bit display data DR, DG, and DB, which have been latched and shifted in levels. The D/A conversion circuit 26 then outputs the results as display signals.

These display signals having various voltage levels are fed as tone display voltages from the output circuit 27 which includes a voltage follower circuit via the output terminals 28 for a liquid-crystal-drive voltage to source signal lines 14 of the liquid crystal display elements in the liquid crystal panel 1, so that a tone display is effected according to the display signals derived from the display data D.

Incidentally, conventionally, if the clock frequency of the clock signal CK is specified to a high value in response to the data transfer rate of the display data D that is specified to a high value so as to improve the resolution for the displayed image, it becomes difficult to ensure the duty ratio (the ratio of the high period to the low period) of the clock signal CK in the source driver 902, leading to an increased likelihood of reducing the operating frequencies of the clock signal CK. Accordingly, conventionally, the quality of displayed images inevitably deteriorate due to the instability of serial-to-parallel conversion of the display data D caused by the reduction in the operating frequencies.

In the present invention, these problems do not occur, since it is possible to specify the clock frequency of the clock signal CK to a low value even when the data transfer rate for the display data D is specified to a high value to improved the resolution of displayed images.

As detailed so far, a semiconductor device in accordance with the present invention is a semiconductor device for driving a display device according to a display data signal, and includes: transfer means for transferring a start pulse signal derived from a clock signal; latch means for picking up the incoming display data signal in synchronism with the clock signal and outputting the display data signal as synchronous data; and sampling means for sampling and outputting the synchronous data according to the transferred start pulse signal, wherein the latch means is adapted to pick up the display data signal at both a leading edge and a trailing edge of the clock signal.

The foregoing semiconductor device may be such that the latch means includes latch circuits arranged in pairs to convert the incoming serial display data signal to parallel signals.

The foregoing semiconductor device is preferably such that the latch means converts the incoming serial display data signal to parallel signals at both the leading and trailing edges of the single phase clock signal.

With the arrangement, the latch means synchronizes the display data signal with the clock signal to output synchronous data, and the sampling means performs sampling on the synchronous data according to the start pulse signal transferred from the transfer means to produce an output. Thereby, the display data signal can be converted from serial to parallel. The resultant signal (display signal) is suitable for use in a display device to effect a display.

Further, with the arrangement, the latch means is adapted to pick up the display data signal at both the leading and trailing edges of the clock signal; therefore, the clock frequency of the clock signal can be reduced further relative to the data transfer rate of the display data signal. Thus, the arrangement makes it easier to ensure the specifications (data setup/hold time) of the clock signal CK from which timings are obtained for the picking-up of the display data.

In order to solve the above problems, another semiconductor device in accordance with the present invention is a semiconductor device for driving a display device according to a display data signal, and includes: transfer means for transferring a start pulse signal derived from a clock signal; latch means for picking up the incoming display data signal in synchronism with the clock signal and outputting the display data signal as synchronous data; and sampling means for sampling and outputting the synchronous data according to the transferred start pulse signal, wherein the latch means is adapted to pick up the display data signal at both leading edges and trailing edges of a plurality of clock signals that are out of phase from one another.

In this semiconductor device, the latch means may include latch circuits arranged in combinations each of which is made up of four of the latch circuits to convert the incoming serial display data signal to parallel signals.

In the semiconductor device, the plurality of clock signals are specified so as to be 360°/(2m) out of phase sequentially, where m is an integer larger than 2 and is representative of the number of the clock signals.

With the arrangement, the latch means is adapted to pick up the display data signal at both leading edges and trailing edges of a plurality of clock signals that are out of phase from one another; therefore, the clock frequency of the clock signal can be reduced further relative to the data transfer rate required for the display data signal. Thus, the arrangement makes it easier to ensure the specifications (data setup/hold time) of the clock signal CK from which timings are obtained for the picking-up of the display data.

In the semiconductor device, the display device may include a liquid crystal display section. With the arrangement, the display device provides a versatile and reliable solution to improvement of the resolution and the quality of displayed images of the liquid crystal display section.

A display module in accordance with the present invention includes any one of the foregoing semiconductor devices. With the arrangement, the display module provides a versatile and reliable solution to improvement of the resolution and the quality of displayed images.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A semiconductor device for driving a display device according to a display data signal, comprising:

transfer means for transferring a start pulse signal derived from a clock signal;

latch means for picking up the incoming display data signal in synchronism with the clock signal and outputting the display data signal as synchronous data; and sampling means for sampling and outputting the synchronous data according to the transferred start pulse signal, wherein the latch means is provided to pick up incoming serial the display data signal and convert to parallel signal at both a leading edge and a tailing edge of the clock signal.

2. The semiconductor device as defined in claim 1, wherein the latch means includes latch circuits arranged in pairs to convert the incoming serial display data signal to parallel signals.

3. The semiconductor device as defined in claim 1, wherein the latch means converts the incoming serial display data signal to parallel signals at both the leading and trailing edges of the single clock signal.

4. The semiconductor device as defined in claim 1, wherein:

the transfer means is a shift register circuit;

the latch means is a flip-flop circuit; and the sampling means is memory.

5. The semiconductor device as defined in claim 1, wherein the display device is a liquid crystal display device.

6. A semiconductor device for driving a display device according to a display data signal, comprising:

transfer means for transferring a start pulse signal derived from a clock signal;

latch means for picking up the incoming display data signal in synchronism with the clock signal and outputting the display data signal as synchronous data; and sampling means for sampling and outputting the synchronous data according to the transferred start pulse signal, wherein the latch means is provided to pick up incoming serial the display data signal and convert to parallel signal at both leading edges and trailing edges of a plurality of clock signals that are out of phase from one another.

7. The semiconductor device as defined in claim 6, wherein the latch means includes latch circuits arranged in combinations each of which is made up of four of the latch circuits to convert the incoming serial display data signal to parallel signals.

8. The semiconductor device as defined in claim 6, wherein the plurality of clock signals are specified so as to be 360°/(2m) out of phase sequentially, where m is an integer larger than 2 and is representative of the number of the clock signals.

9. The semiconductor device as defined in claim 6, wherein:

the transfer means is a shift register circuit;

the latch means is a flip-flop circuit; and the sampling means is memory.

10. The semiconductor device as defined in claim 6, wherein the display device is a liquid crystal display device.

11. A display module, comprising the semiconductor device as defined in claim 1.

12. A display module, comprising the semiconductor device as defined in claim 6.

13. The semiconductor device as defined in claim 8, wherein $m=2^k$ (k=0, 1, 2, 3, . . . ).

* * * * *